US010094519B1

(12) United States Patent
Stranczek et al.

(10) Patent No.: US 10,094,519 B1
(45) Date of Patent: Oct. 9, 2018

(54) LIGHT FIXTURE RETROFIT KIT AND BRACKETS THEREOF

(71) Applicant: Flex Ltd., Singapore (SG)

(72) Inventors: Mark Stranczek, Grapvine, TX (US); Jordon Musser, Dallas, TX (US); Kevin Emr, Dallas, TX (US)

(73) Assignee: FLEX LTD., Singapore (SG)

( * ) Notice: Subject to any disclaimer, the term of this patent is extended or adjusted under 35 U.S.C. 154(b) by 0 days.

(21) Appl. No.: 15/715,233

(22) Filed: Sep. 26, 2017

(51) Int. Cl.

| | |
|---|---|
| ***F21K 9/275*** | (2016.01) |
| ***F21V 17/02*** | (2006.01) |
| ***F21K 9/272*** | (2016.01) |
| *F21Y 103/10* | (2016.01) |
| *F21Y 115/10* | (2016.01) |

(52) U.S. Cl.
CPC ..... *F21K 9/275* (2016.08); *F21K 9/272* (2016.08); *F21V 17/02* (2013.01); *F21Y 2103/10* (2016.08); *F21Y 2115/10* (2016.08)

(58) Field of Classification Search
CPC ... F21S 8/026; F21S 8/04; F21S 8/043; F21V 5/007
See application file for complete search history.

(56) References Cited

U.S. PATENT DOCUMENTS

| | | | | |
|---|---|---|---|---|
| 5,997,158 | A * | 12/1999 | Fischer | F21S 8/04 362/364 |
| 6,059,424 | A * | 5/2000 | Kotloff | F21V 17/107 362/220 |
| 6,739,734 | B1 | 5/2004 | Hulgan | |
| 7,296,911 | B2 | 11/2007 | Plunk et al. | |
| 8,083,369 | B1 * | 12/2011 | Richardson | F21S 8/026 362/217.11 |
| 9,494,304 | B2 | 11/2016 | Dixon | |
| 9,927,072 | B2 * | 3/2018 | Scribante | F21K 9/278 |
| 2013/0235568 | A1 * | 9/2013 | Green | F21V 3/06 362/218 |
| 2015/0016100 | A1 * | 1/2015 | Ishii | F21S 8/043 362/223 |
| 2015/0267873 | A1 * | 9/2015 | Price | F21V 21/03 362/235 |
| 2015/0276125 | A1 * | 10/2015 | Pratt | F21S 2/005 362/217.15 |

* cited by examiner

*Primary Examiner* — Anne Hines
(74) *Attorney, Agent, or Firm* — Carter, DeLuca, Farrell & Schmidt, LLP

(57) ABSTRACT

A visible LED retrofit kit includes a chassis for an LED assembly and an elongated bracket including a first end portion and a bifurcated second end portion. The first end portion of the bracket is configured to be bent for attachment thereof to a first longitudinal side of a light fixture housing. The second end portion of the bracket includes a first tab and a second tab. The first tab is configured to be bent for attachment of the second end portion to a second longitudinal side of the light fixture housing. The second tab is configured to movably couple the chassis to the second longitudinal side of the light fixture housing.

20 Claims, 6 Drawing Sheets

LIGHT FIXTURE RETROFIT KIT AND BRACKETS THEREOF

BACKGROUND

1. Technical Field

The present disclosure relates to light fixtures. More specifically, the present disclosure relates to a retrofit kit and method of retrofitting fluorescent light fixtures with light-emitting diodes.

2. Background of Related Art

Surface mount fluorescent strip light fixtures are complete electric units typically mounted to a ceiling of warehouses and retail stores, such as, for example, grocery, drug, and department stores, in which the fixtures are commonly mounted in continuous rows to provide general illumination lighting. Surface mount fluorescent strip light fixtures include a channel in the form of an inverted trough that is attached to the ceiling, lamp holders (i.e., sockets) attached to the channel, a ballast disposed within the channel, and a linear fluorescent lamp positioned in the lamp holders. A ballast cover closes an open face of the channel to enclose the ballast and associated wiring. The lamps are usually left exposed to permit light to pass into the room. Due to their low cost and utility, these types of light fixture are one of best-selling light fixtures of all time.

Since the introduction of the fluorescent lamp at the 1939 World Fair, light technology has advanced to include alternative lighting options, such as visible light-emitting diodes ("LEDs") that consume less energy, have longer lives, and are smaller in size. However, implementation of newer lighting technology requires either replacing the individual components of the fluorescent light fixture (e.g., ballast, lamp holders, wiring, and lamps) or replacing the entire light fixture. Either of these options is labor-intensive and time consuming. In some instances, it may take 30 minutes or more to retrofit or replace each fixture. In addition, the retrofit process may require closing down sections of a facility during the construction, increasing the impact of the time and effort required to retrofit or replace the light fixtures.

Accordingly, there is a need for an easy to install retrofit kit and method for surface mount or suspension fluorescent strip light fixtures and other obsolete light fixtures.

SUMMARY

The present disclosure provides a visible LED retrofit kit overcoming the drawbacks of the prior art. In one aspect of the present disclosure, the visible LED retrofit kit includes a chassis for an LED assembly and an elongated first bracket including a first end portion and a bifurcated second end portion. The first end portion defines a first row of perforations and a first hole located above the first row of perforations dimensioned for receipt of a fastener. The first end portion is configured to be bent about the first row of perforations for attachment of the first end portion to a first longitudinal side of a light fixture housing. The second end portion includes a first tab and a second tab. The first tab defines a first row of perforations and a first hole located below the first row of perforations. The first tab is configured to be bent about the first row of perforations thereof for attachment of the second end portion to a second longitudinal side of the light fixture housing. The second tab is configured to movably couple the chassis to the second longitudinal side of the light fixture housing.

In embodiments, the second tab may be configured to rotatably couple the chassis to the light fixture housing, such that the chassis is movable relative to the first bracket and the light fixture housing between a pre-assembled position and an assembled position. In the pre-assembled position, a first longitudinal side of the chassis is disposed adjacent the first end portion of the first bracket and a second longitudinal side of the chassis is remote from the second end portion of the first bracket. In the assembled position, the first and second longitudinal sides of the chassis are disposed adjacent the respective first and second end portions of the first bracket.

In embodiments, the chassis may be configured to rotate approximately 90 degrees relative to the first bracket between the pre-assembled and assembled positions.

In embodiments, the chassis may include an elongate body and a coupling extending from a longitudinal side of the elongate body. The coupling may be configured to attach to the second tab of the first bracket. The second tab of the first bracket may define a slot dimensioned for receipt of the coupling of the chassis. The coupling may be a hook configured to be captured in the slot of the second tab.

In embodiments, the first bracket may have an intermediate portion interconnecting the first and second end portions. The intermediate portion may define an opening dimensioned for receipt of a fastener for coupling the first bracket to the chassis. The chassis may define an opening that is aligned with the opening of the intermediate portion of the first bracket when the chassis is assembled to the first bracket.

In embodiments, the second tab may define a plurality of perforations and a slot located below the perforations. The second tab may be configured to be bent about the perforations thereof.

In embodiments, the second tab may extend beyond the first tab when the first and second tabs are in their bent configurations.

In embodiments, the first end portion may define a second row of perforations and a second hole located above the second row of perforations.

In embodiments, the first end portion and the first tab of the second end portion may be coaxial, and the second tab of the second end portion may be laterally offset from both the first end portion and the first tab of the second end portion.

In embodiments, the retrofit kit may further include an elongated second bracket including a first end portion and a bifurcated second end portion. The first end portion defines a first row of perforations and a first hole located above the first row of perforations. The first end portion of the second bracket is configured to be bent about the first row of perforations thereof for attachment of the first end portion of the second bracket to the first longitudinal side of the light fixture housing. The second end portion of the second bracket includes a first tab and a second tab. The first tab defines a first row of perforations and a first hole located below the first row of perforations of the first tab of the second bracket. The first tab of the second bracket is configured to be bent about the first row of perforations thereof for attachment of the second end portion of the second bracket to the second longitudinal side of the light fixture housing. The second tab is configured to couple the chassis to the second longitudinal side of the light fixture housing. The first and second brackets are spaced longitudinally from one another along the length of the chassis.

In another aspect of the present disclosure, a bracket for coupling an LED assembly to a light fixture housing is provided and includes a first end portion and a bifurcated second end portion. The first end portion defines a first row of perforations and a first hole located above the first row of perforations dimensioned for receipt of a fastener. The first end portion is configured to be bent about the first row of perforations for attachment of the first end portion to a first longitudinal side of a light fixture housing. The second end portion includes a first tab and a second tab. The first tab defines a first row of perforations and a first hole located below the first row of perforations. The first tab is configured to be bent about the first row of perforations thereof for attachment of the second end portion to a second longitudinal side of the light fixture housing. The second tab defines a first row of perforations and a slot located below the first row of perforations of the second tab. The second tab is configured to be bent about the first row of perforations thereof for attachment to a chassis for supporting an LED assembly.

In yet another aspect of the present disclosure, a method of installing an LED assembly to a light fixture housing using a retrofit kit is provided. The method includes removing components of a light fixture from a housing of the light fixture, bending a first end portion and a second end portion of each of a pair of brackets relative to an intermediate portion of each of the pair of brackets, securing a first bracket of the pair of brackets to a first end of the housing of the light fixture, and securing a second bracket of the pair of brackets to a second end of the housing of the light fixture. The bent first end portion of the first bracket is attached to a first longitudinal side of the housing of the light fixture, and a first tab of the bent second end portion of the first bracket is attached to a second longitudinal side of the housing of the light fixture. The bent first end portion of the second bracket is attached to the first longitudinal side of the housing of the light fixture, and a first tab of the bent second end portion of the second bracket is attached to the second longitudinal side of the housing of the light fixture. A first longitudinal side of a chassis is coupled to a second tab of the second end portion of each of the pair of brackets. An LED assembly is attached to an outer surface of the chassis. The chassis is rotated relative to the pair of brackets about the second tab of the second end portion of each of the pair of brackets to position an inner surface of the chassis adjacent the intermediate portions of each of the pair of brackets. The chassis is fastened to the pair of brackets.

Further details, advantages, and aspects of exemplary embodiments of the present disclosure are described in more detail below with reference to the appended figures.

As used herein, the terms parallel and perpendicular are understood to include relative configurations that are substantially parallel and substantially perpendicular up to about + or −10 degrees from true parallel and true perpendicular.

BRIEF DESCRIPTION OF THE DRAWINGS

Embodiments of the present disclosure are described herein with reference to the accompanying drawings, wherein.

DETAILED DESCRIPTION

Figure 1:
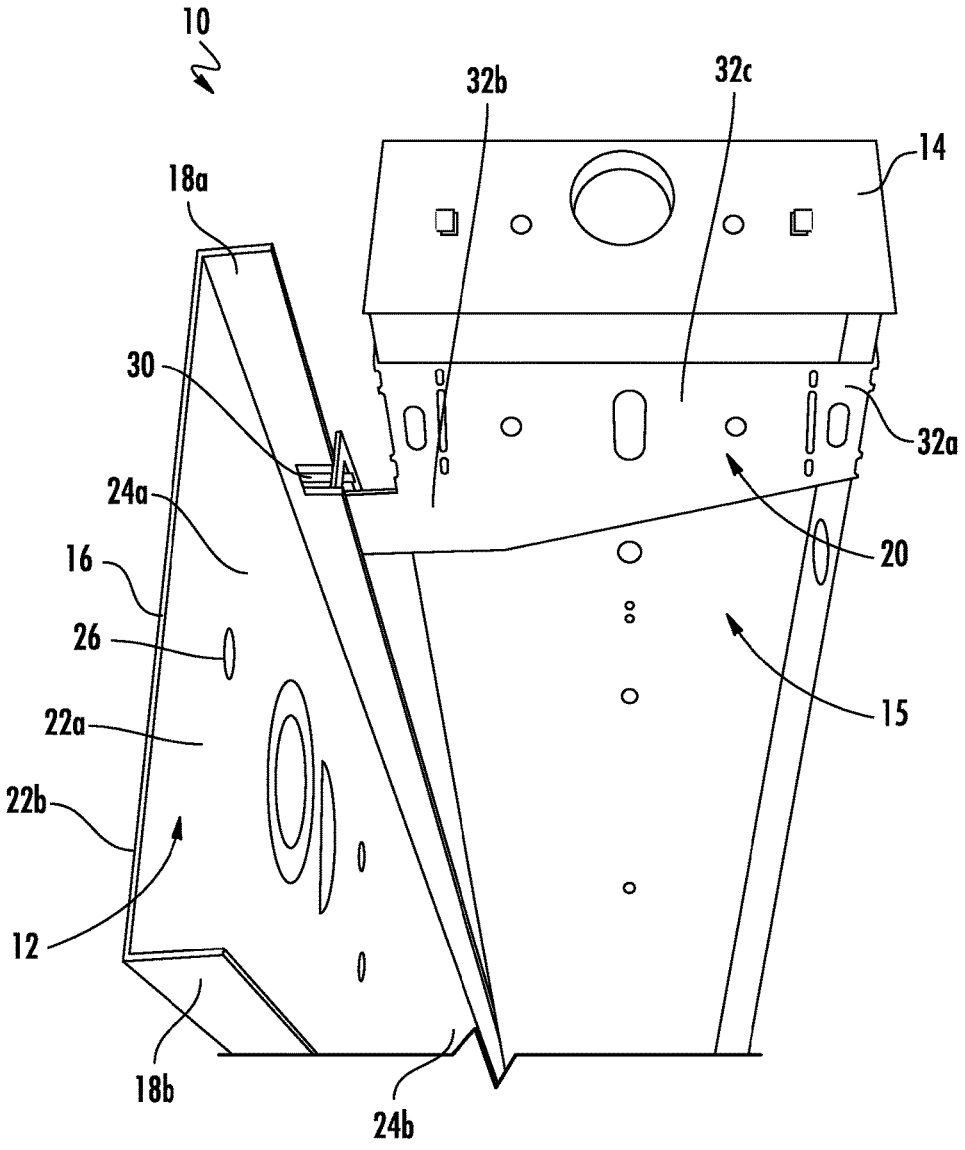
FIG. 1 is a bottom, perspective view of a visible LED retrofit kit in a pre-assembled state coupled to a barren light fixture housing in accordance with the principles of the present disclosure.

Embodiments of the presently disclosed visible LED retrofit kit and methods of installing the same are described in detail with reference to the drawings, in which like reference numerals designate identical or corresponding elements in each of the several views.

The present disclosure provides a visible LED retrofit kit for installing an LED assembly to a gutted housing of a fluorescent light fixture. The retrofit kit includes a chassis for supporting the LED assembly and a pair of brackets for coupling the chassis to the light fixture housing. The brackets have rows of perforations defined in both ends to allow for the installer to select the width of the bracket based on the width of the light fixture housing and bend the ends of the brackets about the perforations. One end of each of the brackets has a mating feature that couples to a corresponding mating feature on the chassis. When coupled, the mating features of the chassis and each of the brackets rotatably couples the chassis to the light fixture housing so that the chassis can hang from the housing of the light fixture while the installer attaches the LED assembly to the chassis and wires the upgraded light fixture. Upon completing the wiring and installation of the LED bulb assembly to the light fixture housing, the chassis, along with the now-attached LED assembly, may be rotated upward toward the brackets and the light fixture housing and fastened to the brackets. These and further details of the retrofit kit will be described below.

With reference to FIGS. 1-6, a retrofit kit, such as a visible light-emitting diode ("LED") retrofit kit 10 is illustrated and generally includes an elongated chassis 12 for supporting an LED assembly (not shown), and a bracket 20 for retrofitting the chassis 12 to a housing 14 of a light fixture (e.g., a surface-mount or suspension fluorescent strip light fixture).

Figure 2:
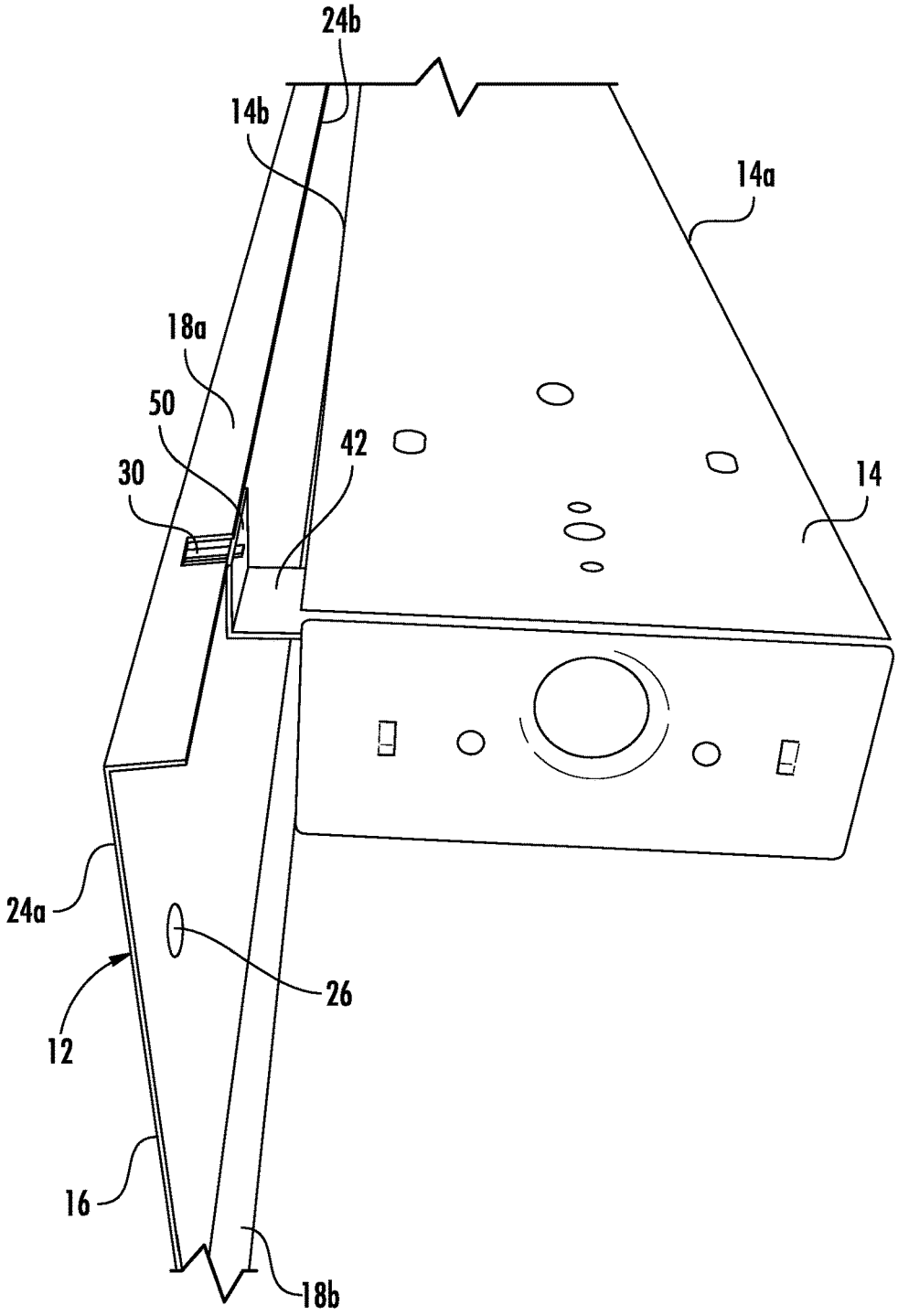
FIG. 2 is a top, perspective view of the retrofit kit of FIG. 1 in a pre-assembled state coupled to the light fixture housing.
Figure 3:
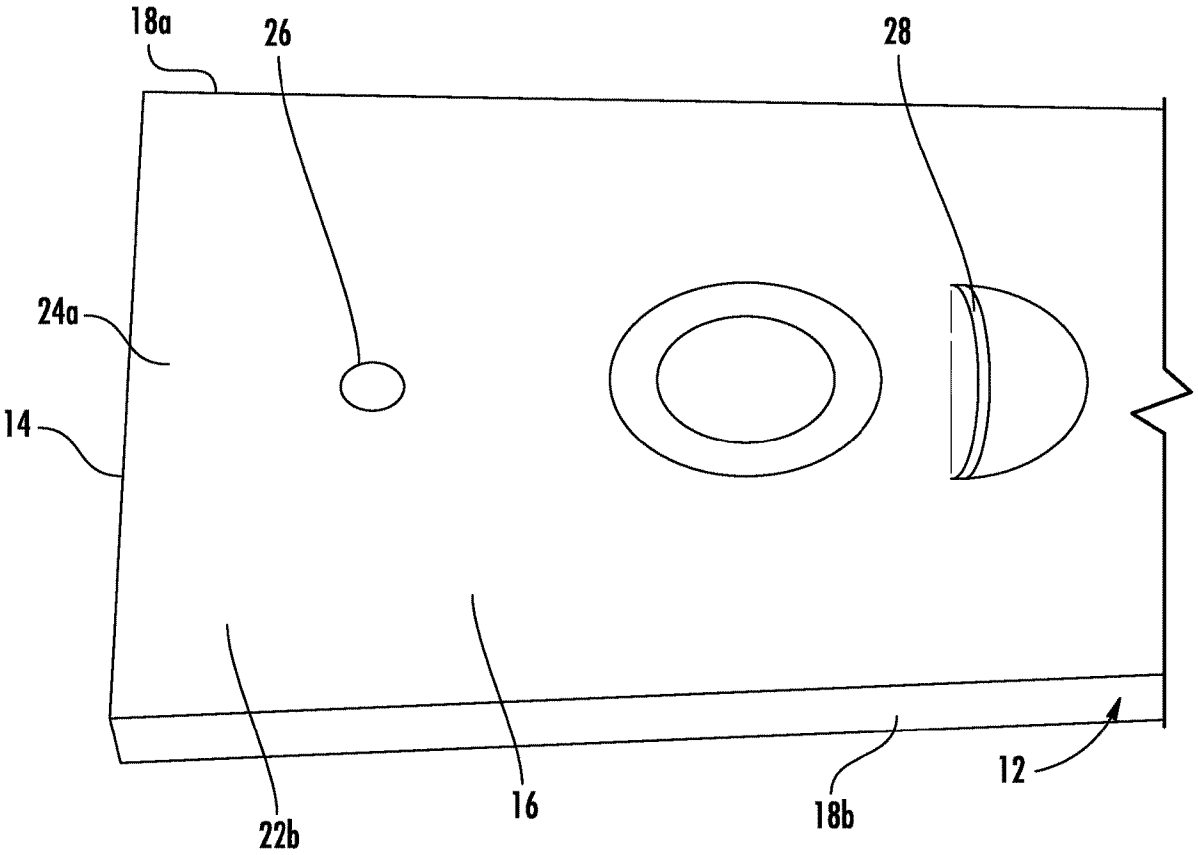
FIG. 3 is a bottom, perspective view of an end of a chassis of the retrofit kit of FIG. 2, illustrating the retrofit kit in an assembled state coupled to the light fixture housing.

With reference to FIGS. 1-3, the chassis 12 of the retrofit kit 10 has a generally rectangular shape and includes an elongate body 16 and a pair of parallel, longitudinal sides 18*a*, 18*b* extending perpendicularly from the elongate body 16. It is contemplated that the chassis 12 may assume any shape suitable for covering or substantially covering a strip channel 15 of a light fixture housing 14, such as, for example, square, rounded, or the like. The elongate body 16 of the chassis 12 may have a planar configuration and has an inner surface 22*a*, an outer surface 22*b*, and first and second end portions 24*a*, 24*b* each of which defining an opening 26 that extends through the inner and outer surfaces 22*a*, 22*b*. The openings 26 are each dimensioned for receipt of a fastener (not explicitly shown) for securing the chassis 12 to the bracket 20. The outer surface 22*b* of the elongate body 16 has connectors 28 extending therefrom configured to attach an LED assembly (not explicitly shown) to the chassis 12.

One of the longitudinal sides 18*a* or 18*b* of the chassis 12 has at least a pair of couplings, such as, for example, hooks 30, for coupling the chassis 12 to the bracket 20. The hooks 30 are located at the opposing first and second end portions 24*a*, 24*b* of the chassis 12. Upon coupling the hooks 30 of the chassis 12 to two respective brackets 20, the chassis 12 becomes hingedly coupled to the brackets 20, such that the chassis 12 is rotatable approximately 90° relative to the brackets 20 between pre-assembled and assembled positions, as will be described in detail below.

Figure 4:
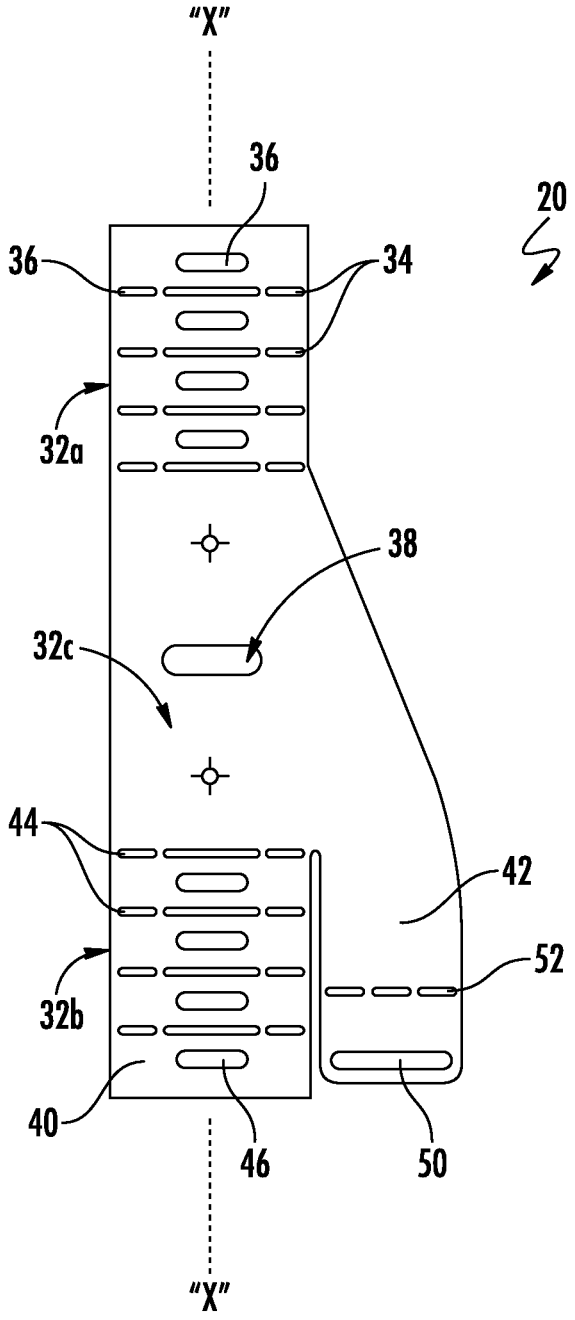
FIG. 4 is a top view of a bracket of the retrofit kit of FIG. 1, illustrated in a pre-bent configuration.
Figure 5:
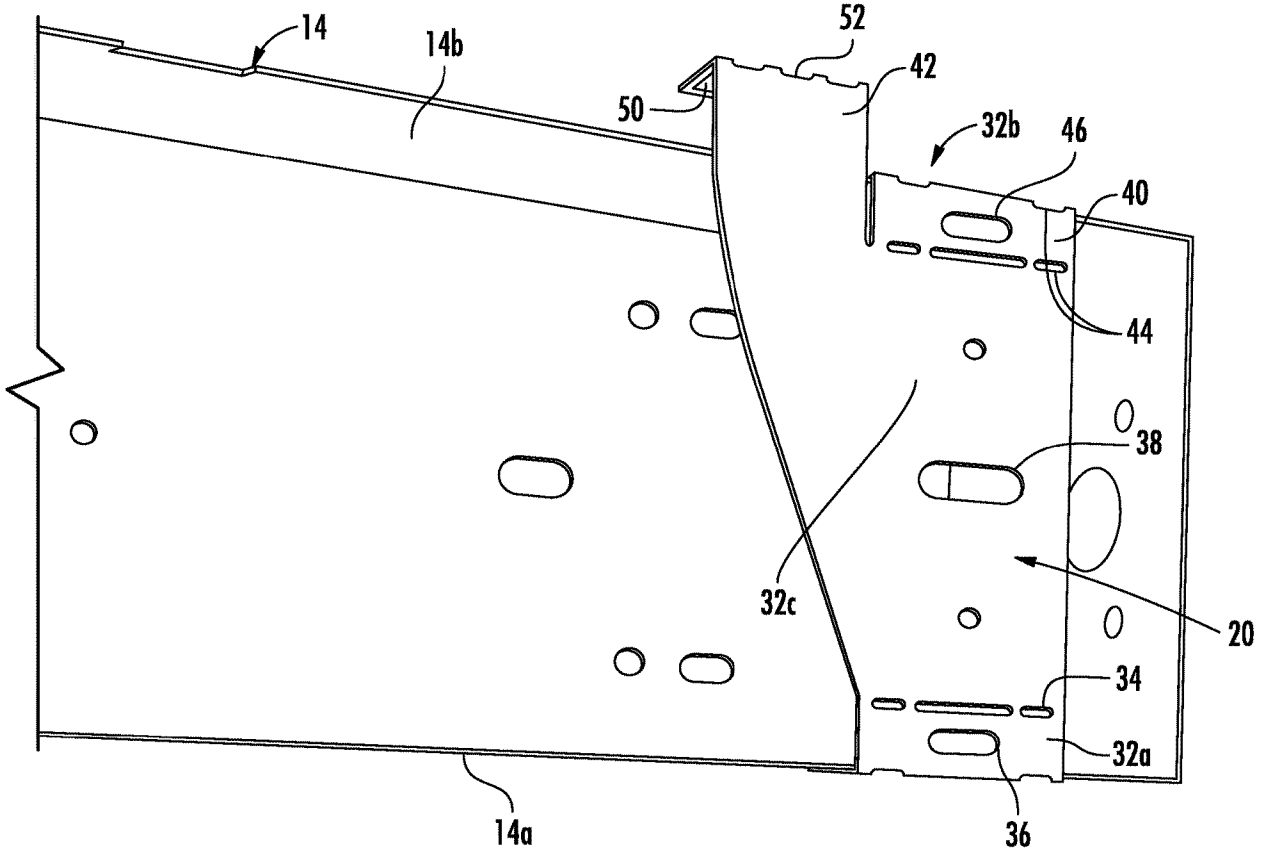
FIG. 5 is a bottom, perspective view of the bracket of FIG. 4 in a bent configuration and fastened to the light fixture housing.
Figure 6:
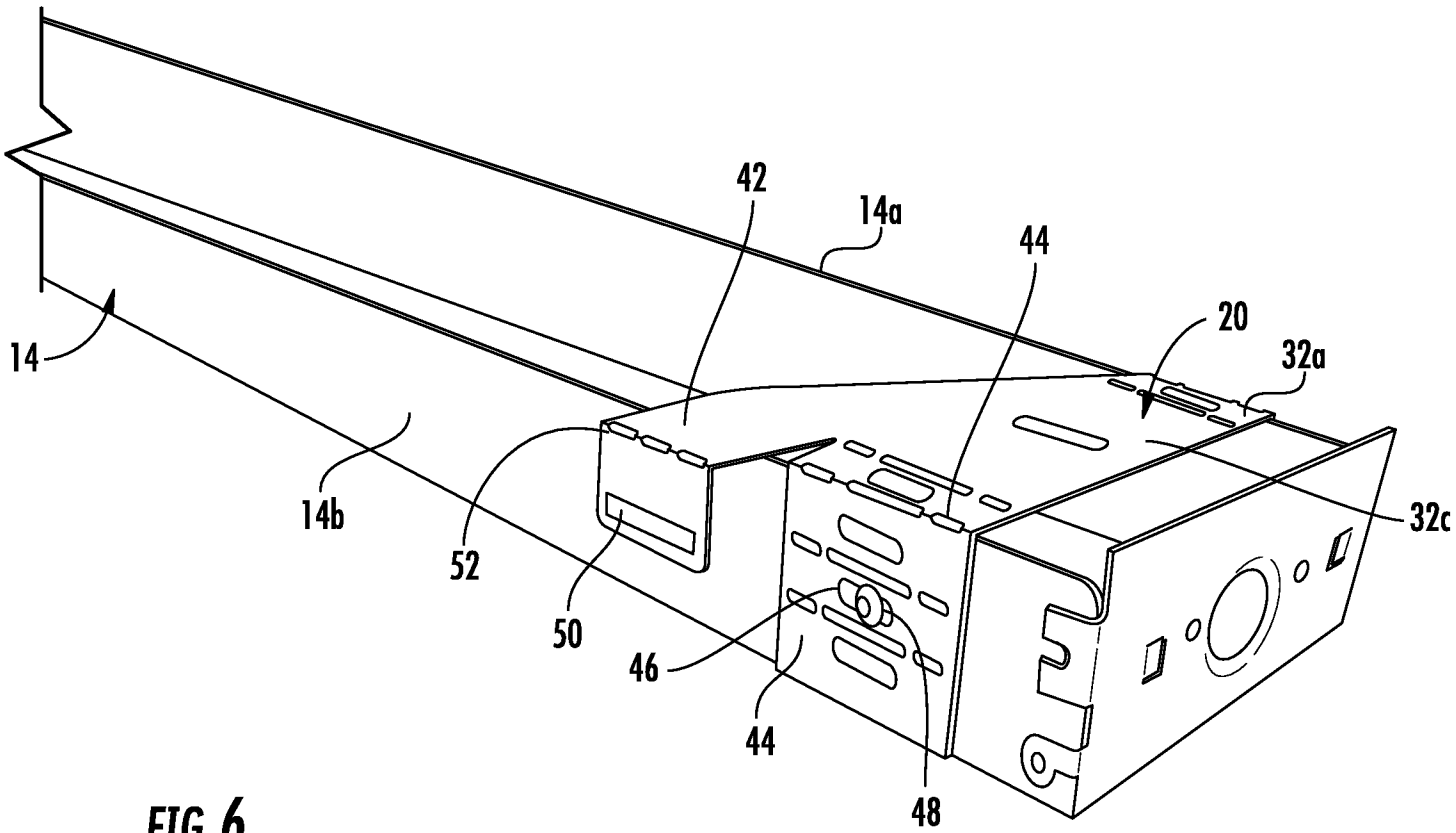
FIG. 6 is a side, perspective view of the bracket of the retrofit kit of FIG. 1, illustrated in a bent configuration and fastened to the light fixture housing.

With reference to FIGS. 4-6, only one of the two brackets 20 of the retrofit kit 20 will be described in detail since each of the brackets 20 are identical or substantially identical. In embodiments, the retrofit kit 10 may include more than two brackets 20 or only one bracket 20 depending on the type and size of the light fixture housing 14 being retrofitted. The bracket 20 is elongated and planar prior to being formed or bent to a selected size suitable for the type and size of light fixture housing 14 being retrofitted.

The bracket 20 generally includes first and second end portions 32*a*, 32*b* and an intermediate portion 32*c* interconnecting the first and second end portions 32*a*, 32*b*. The first and second end portions 32*a*, 32*b* and the intermediate portion 32*c* may be fabricated from a piece of sheet metal (e.g., aluminum) and may be integrally connected or monolithically formed. In embodiments, the bracket 20 may be fabricated from any suitable material. For illustrative purposes only, the first end portion 32*a* of the bracket 20 is said to be located above the intermediate and second end portions 32*c*, 32*b* of the bracket 20, and the second end portion 32*b* of the bracket 20 is said to be located below the first and intermediate portions 32*a*, 32*b* of the bracket 20. The references "above" and "below" are relative and used only in the context to the other, and are not necessarily "superior" and "inferior."

The first end portion 32*a* of the bracket 20 has a rectangular configuration and defines a series of rows of perforations 34. In embodiments, each perforation 34 may rounded, elongated, or any combination thereof. The rows of perforations 34 may extend perpendicularly relative to a longitudinal axis "X" defined by the bracket 20 and are spaced from one another a selected distance along the longitudinal axis "X." The rows of perforations 34 permit the first end portion 32*a* of the bracket 20 to be bent about either of the rows of perforations 34 to adjust the length of the first end portion 32*a*, as shown in FIGS. 5 and 6. The first end portion 32*a* further defines a plurality of holes 36 dimensioned for receipt of a fastener (not explicitly shown) for securing the bracket 20 to a first longitudinal side 14*a* of a light fixture housing 14. One of each of the holes 36 is located above one of each of the rows of perforations 34. In embodiments, one of each of the holes 36 may be located below one of each of the rows of perforations 34.

The intermediate portion 32*c* of the bracket 20 has a rectangular configuration and defines an opening 38 aligned with the holes 36 of the first end portion 32*a* along the longitudinal axis "X." The opening 38 of the intermediate portion 32*c* is dimensioned for receipt of a fastener (not explicitly shown) for coupling the bracket 20 to an end portion 24*a* or 24*b* of the chassis 12. In particular, the opening 38 of the intermediate portion 32*c* aligns with the opening 26 (FIGS. 1 and 2) in one of the end portions 24*a* or 24*b* of the chassis 12 when the chassis 12 is assembled to the bracket 20, as shown in FIG. 3. As such, a fastener (e.g., a canoe clip, a screw, or the like) may extend through the respective openings 26 and 38 of the chassis 12 and the intermediate portion 32*c* of the bracket 20 to secure the chassis 12 to the bracket 20. In embodiments, the chassis 12 may be fastened to the bracket 20 via any suitable fastening mechanism, including, but not limited to, adhesives, hinges, clips, ties, straps, belts, tapes and/or fabric hook-and-loop fasteners.

The second end portion 32*b* of the bracket 20 is bifurcated, whereby the second end portion 32*b* has a first tab 40 and a second tab 42 disposed laterally of the first tab 40. The first tab 40 is coaxially aligned with the first end portion 32*a* of the bracket 20 along the longitudinal axis "X," whereas the second tab 42 is offset from the longitudinal axis "X." The first tab 40 of the second end portion 32*b* has a rectangular configuration and defines a series of rows of perforations 44, similar to the rows of perforations 34 in the first end portion 32*a*. The rows of perforations 44 permit the first tab 40 to be bent about either of the rows of perforations 44 to adjust the length of the first tab 40 of the second end portion 32*b*, as shown in FIGS. 5 and 6. The first tab 40 of the second end portion further defines a plurality of holes 46 dimensioned for receipt of a fastener 48 (FIG. 6) for securing the bracket 20 to a second longitudinal side 14*b* of the light fixture housing 14. One of each of the holes 46 is located below one of each of the rows of perforations 44. In embodiments, one of each of the holes 46 may be located above one of each of the rows of perforations 44.

The second tab 42 of the second end portion 32*b* is an offshoot from the intermediate portion 32*c* of the bracket 20. In embodiments, the second tab 42 of the second end portion 32*b* may be an offshoot from the first tab 40 rather than the intermediate portion 32*c*. The second tab 42 has a mating feature, such as, for example, an elongated slot 50, dimensioned for receipt and capture of the hook 30 (FIGS. 1 and 2) of the chassis 12. Upon disposing the hook 30 of the chassis 12 in the slot 50 of the second tab 42, the chassis 12 is rotatable relative to the bracket 20. The second tab 42 of the second end portion 32*b* of the bracket 20 defines at least one row of perforations 52 located above slot 50. The row of perforations 52 permits the second tab 42 of the second end portion 32*b* of the bracket 20 to be bent about thereabout prior to the retrofitting installation, as shown in FIGS. 5 and 6. In this way, the entire bracket 20 may remain planar prior its use, which allows for stacking in storage and shipping. The second tab 42 extends beyond (i.e., below) the first tab 40 when the first and second tabs 40, 42 are in their bent configurations.

A light fixture, such as a surface-mount fluorescent strip light fixture may be retrofitted with an LED assembly (not explicitly shown) utilizing the retrofit kit 10 described above. Prior to installing the retrofit kit 10 and the LED assembly, all components of the light fixture are removed from the light fixture housing 14, e.g., the ballast, lamp holders, linear fluorescent lamps, and wiring. Upon gutting the light fixture, the housing 14 remains attached to the ceiling and can then be repurposed as a holder for an LED assembly using the brackets 20 and the chassis 12 of the retrofit kit 10.

During or prior to installation, the first end portion 32*a* of a first bracket 20 is bent about a selected row of perforations 34 to orient the bent portion approximately 90° relative to the remainder of the first end portion 32*a* of the bracket 20, as shown in FIGS. 5 and 6. The first tab 40 of the second end portion 32*b* of the first bracket 20 is also bent about a selected row of perforations 44 to orient the bent portion approximately 90° relative to the remainder of the first tab 40 of the bracket 20. The row of perforations 34 and 44 of each of the first end portion 32*a* and the first tab 40 of the second end portion 32*b* is selected to size the bracket 20 to approximate the width of the light fixture housing 14. The second tab 42 of the second end portion 32*b* is also bent about its row of perforations 52 to orient the bent portion approximately 90° relative to the remainder of the second tab 42 of the bracket 20.

With the first and second end portions 32*a*, 32*b* of the first bracket 20 in their bent configurations, as shown in FIGS. 5 and 6, the first bracket 20 is placed into engagement with a first end of the housing 14 so that the intermediate portion 32*c* of the bracket 20 spans the width of the housing 14, the bent first end portion 32*a* of the bracket 20 abuts the first longitudinal side 14*a* of the housing 14, and the bent first tab 40 of the second end portion 32*b* of the bracket 20 abuts the second longitudinal side 14*b* of the housing 14. The holes 36, 46 of each of the first end portion 32*a* of the bracket 20 and the first tab 40 of the second end portion 32*b* of the bracket 20 are aligned with holes (not explicitly shown) formed in the respective longitudinal sides 14*a*, 14*b* of the housing 14. Fasteners 48 are inserted into the holes 36, 46 to secure the first and second end portions 32*a*, 32*b* of the bracket 20 to the housing 14.

A second bracket 20 is bent in a similar manner as the first bracket 20 and secured to a second end of the housing 14, such that the first and second brackets 20 are longitudinally spaced along the length of the housing 14. With two brackets 20 attached to the light fixture housing 14, the second tabs 42 of the brackets 20 extend laterally from the second longitudinal side 14*b* of the light fixture housing 14.

As shown in FIGS. 1 and 2, the chassis 12 of the retrofit kit 10 is coupled to the first and second brackets 20 by positioning the hooks 30 of the chassis 12 into the slots 50 of the second tabs 42 of the brackets 20. After the chassis 12 is coupled to the first and second brackets 20, the chassis 12 remains in a pre-assembled position, whereby the chassis 12 hangs from the light fixture housing 14 at approximately a 90° angle, as shown in FIGS. 1 and 2. In the pre-assembled position, an LED assembly (not shown), its wiring, and any other components of the LED assembly, may be installed to the chassis 12. The ability of the chassis 12 to hang from the light fixture housing 14 via the brackets 20 assists in the installation of these components. Upon installing the LED assembly, the chassis 12 may be rotated from the pre-assembled position, about the second tabs 42 of the brackets 20, to an assembled position.

In the assembled position, the inner surface 22*a* of the elongate body 16 of the chassis 12 is disposed over the intermediate portions 32*c* of the brackets 20, with the holes 26 of the opposing ends 24*a*, 24*b* of the chassis 12 aligned with the openings 38 of the intermediate portions 32*c* of the brackets 20, respectively. To secure the chassis 12 to the brackets, fasteners (e.g., canoe clips) are inserted into the holes 26 of the chassis 12 and the openings 38 of the intermediate portions 32*c* of the brackets 20, thereby transforming the light fixture housing 14 from a fluorescent strip light fixture to an LED light fixture.

It will be understood that various modifications may be made to the embodiments disclosed herein. Therefore, the above description should not be construed as limiting, but merely as exemplifications of various embodiments. Those skilled in the art will envision other modifications within the scope and spirit of the claims appended thereto.

The invention claimed is:

1. A visible light-emitting diode (LED) retrofit kit, comprising:

a chassis for an LED assembly; and an elongated first bracket including:

a first end portion defining a first row of perforations and a first hole located above the first row of perforations dimensioned for receipt of a fastener, the first end portion configured to be bent about the first row of perforations for attachment of the first end portion to a first longitudinal side of a light fixture housing; and a bifurcated second end portion including:

a first tab defining a first row of perforations and a first hole located below the first row of perforations of the first tab, the first tab configured to be bent about the first row of perforations thereof for attachment of the second end portion to a second longitudinal side of the light fixture housing; and a second tab configured to movably couple the chassis to the second longitudinal side of the light fixture housing.

2. The retrofit kit according to claim 1, wherein the second tab of the first bracket is configured to rotatably couple the chassis to the light fixture housing, such that the chassis is movable relative to the first bracket and the light fixture housing between a pre-assembled position and an assembled position.

3. The retrofit kit according to claim 2, wherein in the pre-assembled position a first longitudinal side of the chassis is disposed adjacent the first end portion of the first bracket and a second longitudinal side of the chassis is remote from the second end portion of the first bracket, and in the assembled position the first and second longitudinal sides of the chassis are disposed adjacent the respective first and second end portions of the first bracket.

4. The retrofit kit according to claim 3, wherein the chassis is configured to rotate approximately 90 degrees relative to the first bracket between the pre-assembled and assembled positions.

5. The retrofit kit according to claim 1, wherein the chassis includes:

an elongate body; and a coupling extending from a longitudinal side of the elongate body and configured to attach to the second tab of the first bracket.

6. The retrofit kit according to claim 5, wherein the second tab of the first bracket defines a slot dimensioned for receipt of the coupling of the chassis.

7. The retrofit kit according to claim 6, wherein the coupling is a hook configured to be captured in the slot of the second tab.

8. The retrofit kit according to claim 1, wherein the first bracket has an intermediate portion interconnecting the first and second end portions, the intermediate portion defining an opening dimensioned for receipt of a fastener for coupling the first bracket to the chassis.

9. The retrofit kit according to claim 8, wherein the chassis defines an opening that is aligned with the opening of the intermediate portion of the first bracket when the chassis is assembled to the first bracket.

10. The retrofit kit according to claim 1, wherein the second tab defines a plurality of perforations and a slot located below the plurality of perforations, the second tab configured to be bent about the plurality of perforations thereof.

11. The retrofit kit according to claim 10, wherein the second tab extends beyond the first tab when the first and second tabs are in their bent configurations.

12. The retrofit kit according to claim 1, wherein the first end portion defines:

a second row of perforations; and a second hole located above the second row of perforations.

13. The retrofit kit according to claim 1, wherein the first end portion and the first tab of the second end portion are coaxial, and the second tab of the second end portion is laterally offset from both the first end portion and the first tab of the second end portion.

14. The retrofit kit according to claim 1, further comprising an elongated second bracket including:

a first end portion defining a first row of perforations and a first hole located above the first row of perforations of the first end portion of the second bracket, the first end portion of the second bracket configured to be bent about the first row of perforations thereof for attachment of the first end portion of the second bracket to the first longitudinal side of the light fixture housing; and a bifurcated second end portion including:

a first tab defining a first row of perforations and a first hole located below the first row of perforations of the first tab of the second bracket, the first tab of the second bracket configured to be bent about the first row of perforations thereof for attachment of the second end portion of the second bracket to the second longitudinal side of the light fixture housing; and a second tab configured to couple the chassis to the second longitudinal side of the light fixture housing, wherein the first and second brackets are spaced longitudinally from one another along the length of the chassis.

15. A bracket for coupling an LED assembly to a light fixture housing, comprising a first end portion defining a first row of perforations and a first hole located above the first row of perforations dimensioned for receipt of a fastener, the first end portion configured to be bent about the first row of perforations for attachment of the first end portion to a first longitudinal side of a light fixture housing; and a bifurcated second end portion including:

a first tab defining a first row of perforations and a first hole located below the first row of perforations of the first tab, the first tab configured to be bent about the first row of perforations thereof for attachment of the second end portion to a second longitudinal side of the light fixture housing; and a second tab defining a first row of perforations and a slot located below the first row of perforations of the second tab, wherein the second tab is configured to be bent about the first row of perforations thereof for attachment to a chassis for supporting an LED assembly.

16. The bracket according to claim 15, further comprising an intermediate portion interconnecting the first and second end portions, the intermediate portion defining an opening dimensioned for receipt of a fastener for coupling the bracket to the chassis.

17. The bracket according to claim 15, wherein the second tab extends beyond the first tab when the first and second tabs are in their bent configurations.

18. The bracket according to claim 15, wherein the first end portion defines:

a second row of perforations; and a second hole located above the second row of perforations.

19. The bracket according to claim 15, wherein the first end portion and the first tab of the second end portion are coaxial, and the second tab of the second end portion is laterally offset from both the first end portion and the first tab of the second end portion.

20. A method of installing an LED assembly to a light fixture housing using a retrofit kit, the method comprising:

bending a first end portion and a second end portion of each of a pair of brackets relative to an intermediate portion of each of the pair of brackets;

securing a first bracket of the pair of brackets to a first end of the housing of the light fixture, such that the bent first end portion of the first bracket is attached to a first longitudinal side of the housing of the light fixture, and a first tab of the bent second end portion of the first bracket is attached to a second longitudinal side of the housing of the light fixture;

securing a second bracket of the pair of brackets to a second end of the housing of the light fixture, such that the bent first end portion of the second bracket is attached to the first longitudinal side of the housing of the light fixture, and a first tab of the bent second end portion of the second bracket is attached to the second longitudinal side of the housing of the light fixture;

coupling a first longitudinal side of a chassis to a second tab of the second end portion of each of the pair of brackets;

rotating the chassis relative to the pair of brackets about the second tab of the second end portion of each of the pair of brackets to position an inner surface of the chassis adjacent the intermediate portions of each of the pair of brackets; and fastening the chassis to the pair of brackets.

* * * * *